United States Patent [19]

Kelley

[11] 3,940,925

[45] Mar. 2, 1976

[54] ROTARY INTERNAL COMBUSTION ENGINE

[76] Inventor: Arthur P. Kelley, 1836 Augusta Drive, Houston, Tex. 77027

[22] Filed: Jan. 28, 1974

[21] Appl. No.: 437,281

[52] U.S. Cl. ..... 60/39.45; 60/39.61; 418/191; 418/225

[51] Int. Cl.[2]..... F02C 3/02; F02G 3/00; F03C 3/00

[58] Field of Search ..... 60/39.45, 39.61; 123/8.41, 123/8.23, 180 R; 418/225, 186, 196, 191, 206, 183

[56] References Cited

UNITED STATES PATENTS

| | | | |
|---|---|---|---|
| 606,606 | 6/1898 | Unbehend | 418/196 |
| 1,283,614 | 11/1918 | Alvey | 418/225 |
| 1,625,940 | 4/1927 | Herzmark | 123/180 R |
| 2,380,752 | 7/1945 | Grieb | 418/206 X |
| 3,174,435 | 3/1965 | Sisson et al. | 418/206 X |
| 3,667,874 | 6/1972 | Weatherson et al. | 418/206 X |
| 3,724,427 | 4/1973 | Sauder | 123/8.41 X |

FOREIGN PATENTS OR APPLICATIONS

| | | | |
|---|---|---|---|
| 1,311,308 | 10/1961 | France | 60/39.45 |

*Primary Examiner*—Carlton R. Croyle
*Assistant Examiner*—Thomas I. Ross
*Attorney, Agent, or Firm*—Torres & Berryhill

[57] ABSTRACT

A rotary internal combustion engine comprising: a compressor section, a power section and a combustion chamber therebetween. The compressor section may comprise a pair of intermeshing gear members mounted in a compressor housing having an inlet on one side and a discharge on the opposite side. The intermeshing compressor gear members are mounted for rotation in opposite directions to compress and transfer air-fuel mixtures from the inlet to the discharge. The compressor discharge may be connected to the combustion chamber for combustion of the air-fuel mixture therein. The power section may comprise at least one rotor mounted in a housing having an inlet connected to the combustion chamber and through which expanding gases are directed against the periphery of the rotor for driving an output shaft connected thereto. The rotor may be connected to at least one of the compressor gear members for rotation thereof.

5 Claims, 5 Drawing Figures

ROTARY INTERNAL COMBUSTION ENGINE

BACKGROUND OF THE INVENTION

1. Field of the Invention

The present invention pertains to internal combustion engines. More specifically, the present invention concerns rotary type, internal combustion engines.

2. Brief Description of the Prior Art

By far the most commonly used internal combustion engine is the piston-crankshaft type, reciprocating engine. Such engines are relatively inefficient and create pollution problems which are not easily solved.

In recent years there has been an increasing interest in other types of internal combustion engines such as the rotary type. Probably the most well known rotary engine is the one commonly referred to as the "Wankel" engine. Many rotary engines have better pollution characteristics and may also be more efficient than the common reciprocating engine.

Continuing research and development is being conducted on the Wankel engine and many other types of rotary engines have been proposed. A few examples of the various types of rotary internal combustion engines may be seen in the following Schlecter;

U.S. Pat. No. 2,511,441 — Loubiere; U.S. Pat. No. 2,845,777 — Nielson, et al; U.S. Pat. No. 2,782,596 — Lindhagen et al; U.S. Pat. No. 3,175,359 — Schleter; U.S. Pat. No. 3,233,406 — Holt.

As can be seen from these patents, rotary engines include the vane type, volute type, gear type and others. However, as the number of proposed designs indicate, a continual search is being made for more efficient and less polluting engines. The recent energy crisis has accelerated the search for more suitable engines, particularly those for use with automobiles.

SUMMARY OF THE INVENTION

The engine of the present invention may comprise a compressor section, a power section and a combustion chamber therebetween. The compressor section may comprise a pair of intermeshing gear members mounted in a compressor housing having an inlet on one side and a discharge on the opposite side. The intermeshing compressor gear members may be mounted for rotation in opposite directions to compress and transfer air-fuel mixtures from the inlet to the discharge. The discharge is connected to the combustion chamber for combustion of the compressed air-fuel mixtures. The power section may comprise at least one rotor mounted in a housing having an inlet connected to the combustion chamber through which exploding gases are directed against the periphery of the rotor for driving an output shaft connected thereto. The rotor may be connected to at least one of the compressor gear members for rotating the compressor.

In one embodiment the power rotor comprises a pair of intermeshing gear members. In another, a single rotor is provided with a plurality of radial vanes projecting from the periphery thereof. A valve assembly is provided for alternately permitting and blocking flow of expanding gases between the combustion chamber and the periphery of the power rotor. The valve assembly may comprise a unique valve rotor arrangement connected to the power rotor for selectively aligning a radial passage with the power inlet for permitting and blocking of the expanding combustion gases.

Other unique variations are disclosed, including apparatus for precompression of air-fuel mixtures. Unique cooperation between the compressor section and power section is also disclosed.

The rotary internal combustion engine of the present invention is an engine development which is superior to those now in use, particularly the piston-crankshaft type, reciprocating engine. In the present engine, combustion takes place outside of the propulsion mechanism. Therefore, the combustion chamber can be designed for whatever size and shape is required to ensure complete, efficient combustion and minimization of pollution. Fewer moving parts are required, reducing manufacturing, maintenance and repair problems. Other objects and advantages will be seen from a reading of the following description in conjunction with the accompanying drawings.

DESCRIPTION OF PREFERRED EMBODIMENTS

Figure 1:
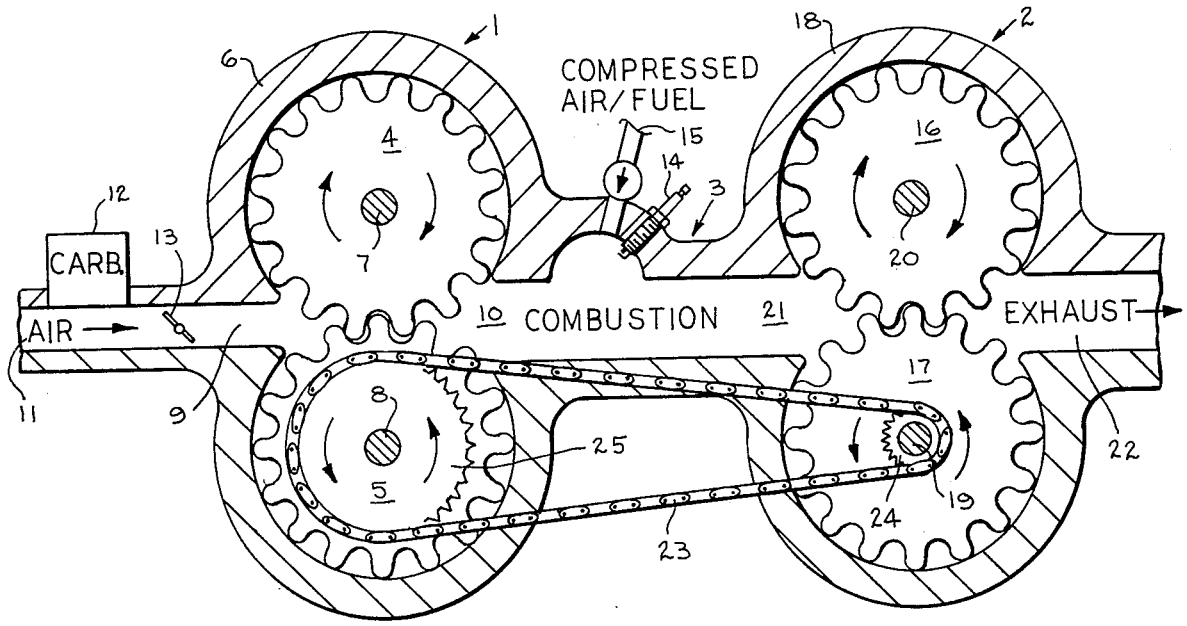
FIG. 1 is a cross-sectional elevation view of a rotary internal combustion according to a preferred embodiment of the invention.

Referring first to FIG. 1, a preferred embodiment of a rotary internal combustion engine, according to the present invention will be described. The engine may comprise a compressor section 1 and a power section 2 connected by a combustion section or chamber 3.

The compression section 1 may comprise a pair of intermeshing gear members 4 and 5 mounted in a compressor housing 6. These gear members are mounted on parallel shafts 7 and 8 and in suitable bearings (not shown) for rotation in opposite directions, as indicated by the arrows thereon. Only enough clearance is provided between the teeth of gear members 4 and 5 to permit rotation in the surrounding housing 6.

The compressor housing 6 is provided with inlet and discharge ports 9 and 10 respectively. The inlet port 9 provides an inlet for an air-fuel mixture provided from an air source 11 and carburetor 12. A suitable throttle 13 may also be provided. The design of carburetors and throttles are well known and will not be further described herein.

The compressor discharge port 10 provides a communication with the combustion chamber 3. The design of combustion chambers is also well known and will not be further described herein except to mention the fact that since the combustion chamber in the present invention is effectively separated from the power section 2, the combustion chamber may be designed as required to ensure complete, efficient combustion without being dependent on the power section, as is the case in piston type engines. As will be more fully explained hereafter, the present invention is one of continual combustion and once combustion is initiated does not require an ignition source. However, for starting the engine, an ignition source, such as spark plug at 14, may be provided as well as an auxilliary source of compressed air-fuel mixture 15.

The power section 2 may comprise a pair of intermeshing gear members 16 and 17 mounted in a surrounding housing 18. Gear members 16 and 17 may be attached to parallel shafts 19 and 20 mounted in suitable bearings (not shown) carried by the housing 18 for rotation in opposite directions as indicated by the arrows thereon. The power section housing 18 is provided with an inlet port 21 and an exhaust port 22. The inlet port 21 provides communication between the combustion chamber 3 and the power rotors or gear members 16 and 17. The exhaust port 22, of course, provides a means of exhausting burned gases, as will be more fully understood hereafter.

The power section 2 may be connected by drive means to the compressor section 1 for supplying power to the compressor. The drive means may comprise a chain 23 connecting sprockets 24 and 25 mounted on shafts 19 and 8, respectively. It will be noted that the diameter of sprocket 25 is substantially greater than the diameter of sprocket 24. This is to produce a mechanical advantage, the purpose of which will be more fully understood hereafter.

In operation, a compressed air-fuel mixture would be first introduced from the auxillary source 15 into combustion chamber 3. Combustion would be initiated by the ignition means 14. Once combustion is initiated, the exploding gases expand and are directed, through power inlet 21, against the periphery of the power gear members 16 and 17, causing them to rotate in the direction shown. The burned gases enter the spaces between the teeth of gears 16 and 17 and are transferred by the rotation thereof to the exhaust port 22 where they are exhausted to the atmosphere or for further handling.

The exploding gases also exert some forces against the compressor gear members 4 and 5 so as to tend to rotate them in a direction opposite to that desired. However, since the drive means by which the power section is connected to the compressor section produces a mechanical advantage, this tendency is overcome and the compressor gear members 4 and 5 are driven by the chain 23 in the direction indicated. An air-fuel mixture is drawn through compressor inlet 9 from the air and fuel sources 11 and 12 respectively, into the spaces between the gear teeth of compressor gears 4 and 5. Alternatively, fuel can be injected into the combustion chamber while air, only, is drawn in by the compressor section. This air-fuel mixture is then compressed and transferred by rotation of the gears through discharge 10 into the combustion chamber 3. Since the air-fuel mixture is being continuously fed into the combustion chamber combustion continues and the auxillary air-fuel mixture 15 and ignition means 14 may be terminated.

The foregoing cycle is continuous and the power generated thereby may be utilized by connection to either one or both of the shafts 19 and 20.

Figure 2:
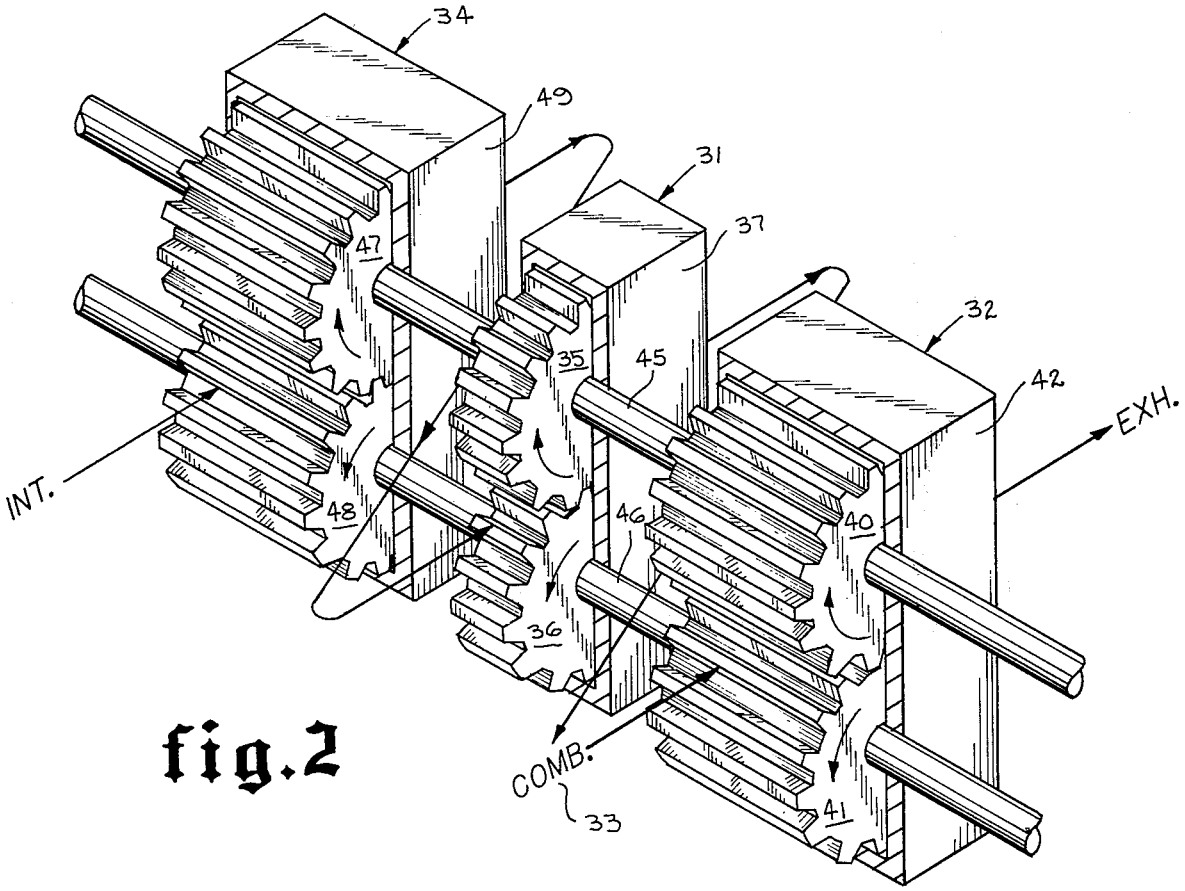
FIG. 2 is a perspective view of an alternate embodiment of an internal combustion engine of the invention, portions of which have been broken away for a clearer understanding thereof.
Figure 3:
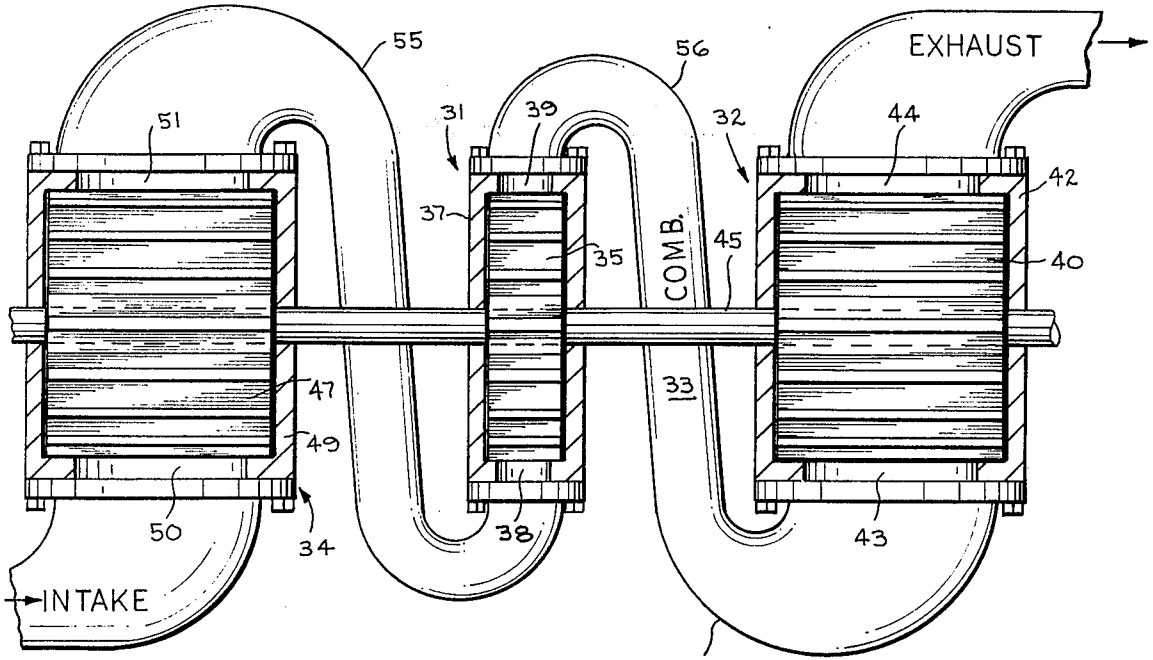
FIG. 3 is a top plan view, partially in section, of the rotary internal combustion engine of FIG. 2.

Referring now to FIGS. 2 and 3, an alternate embodiment of the invention will be described. As in the embodiment of FIG. 1, this embodiment also includes a compressor section 31 and a power section 32 joined by a combustion chamber 33. It may also be provided with a second compressor section 34 which may be referred to as a booster or precharger section.

Like in the previous embodiment, the compressor section 31 may comprise a pair of intermeshing gear members 35 and 36 mounted for rotation within a compressor housing 37. The compressor section is also provided with an inlet 38 through which air-fuel mixtures enter between the teeth and gear members 35 and 36 for compression and transfer to the discharge 39 and into the combustion section 33.

Very little needs to be said about the combustion chamber, except to mention again that combustion takes place outside the power section 32. Therefore the combustion chamber may be designed for whatever size and shape is required to ensure complete, efficient combustion and minimization of pollution. Although it is not shown in FIGS. 2 and 3, combustion chamber 33 may also be provided with auxillary air-fuel source and an ignition source, as in the embodiment of FIG. 1, for initiation of combustion.

Like in the previously described embodiment, the power section 32 of the present embodiment comprises a pair of intermeshing gears 40 and 41 mounted in a power housing 42. The power housing is provided with an inlet 43 and a discharge or exhaust 44.

It will be noticed that there is a substantial difference between the orientation of the compressor and power sections 31 and 32, respectively, and the compressor and power sections of the previous embodiment. In this embodiment, a compressor gear 35 is coaxially mounted with a power gear 40 on a common shaft 45. Likewise, the other compressor gear 36 and power gear 41 are coaxially mounted on a common shaft 46. The shafts 45 and 46 are suitably journaled in bearings carried by the compressor and power housings 37 and 42 respectively. Such an arrangement eliminates the sprocket chain drive means of the previously described embodiment. However, to overcome the tendency to rotate the compressor gears 35 and 36 in a direction opposite to that desired, due to the expanding gases within combustion chamber 33, some mechanical advantage must be obtained. For this reason, the width of power gears 40 and 41 are greater than the width of the compressor gears 35 and 36. Thus, the power gear area on which the expanding gas pressure is acting is greater than the compressor gear area on which it is acting by a ratio proportional to the gear widths. Of course, other means may be provided to obtain a mechanical advantage e.g., difference in diameters of power gears and compressor gears.

The "booster," "precharger" or second compressor section 34 may also comprise a pair of intermeshing gears 47 and 48 mounted in a suitable housing 49. The housing is provided with an inlet 50 and a discharge 51. The discharge 51 is in communication with the inlet 38 of the first compressor section 31. It will also be noted that the second compressor gears 47 and 48 are coaxially mounted on shafts 45 and 46, respectively, with the corresponding gears of first compressor section 31 and power section 32.

It should be noted at this point that the present embodiment could be operated without the second compressor section 34. Such a booster compressor would not significantly affect fuel efficiency. However, it would create a higher operating pressure in the combustion chamber which would in turn permit a given power output to be achieved with a smaller engine. Booster size can be selected so as to give any pressure desired. With higher pressure comes higher temperature, and presumably the limitation on pressure would be the heat resistant quality of the materials economically available. In the embodiment shown, the gears 47 and 48 of the booster or second compressor section 34 are of the same width of the power gears, i.e. three times as great as the width of the first compressor section gears.

Like in the previously discussed embodiment the present engine of course would require an air source, a fuel source from a carburetor or the like and could be provided with a throttle. It will also be noted, as best seen in FIG. 3, that manifolding 55, 56 and 57 is required to connect the discharge and inlet of the various sections.

As in the previous embodiment, operation of the present engine would be initiated by auxillary air-fuel mixture and ignition source at the combustion chamber 33. Once combustion has been initiated it becomes a continual process. The expanding gases from the combustion chamber would enter the power section through inlet 43 exerting pressure against the periphery of the gears 40 and 41 causing them to rotate in the direction of the arrows shown thereon. The burned gases would be carried between the gear teeth for exit through exhaust 44.

Since the power gears are connected to the same shafts as the compressor gears, rotation of the power section would cause rotation of the compressor gears 35, 36 and the second or booster compressor gears 47 and 48. The primary source of fuel and air would be drawn through inlet 50 compressed and transferred by the booster section 34 to its discharge 51 and through manifold 55 to the inlet 38 of the compressor section 31. Further compression and transfer of the compressed air-fuel mixture to the discharge 39 is effected by compressor gears 35 and 36. The fully compressed air-fuel mixture is then transferred through the manifold 56 to combustion chamber 33 where combustion takes place. As previously mentioned, once combustion is initiated in combustion chamber 33 it is continuously fed and the auxillary fuel and ignition sources may be terminated. The exploding, expanding gases in the combustion chamber 33 are transmitted to the power section 32 by manifolding 57 and the process continues.

Figure 4:
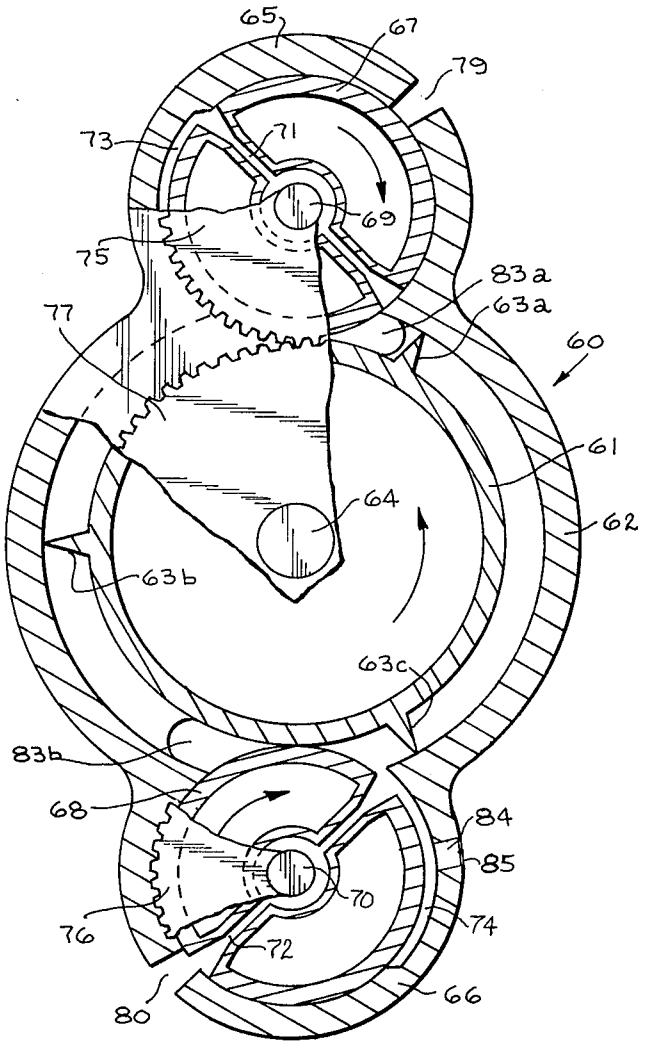
FIG. 4 is an end elevation view, partially in section, of a power section, partially in section, suitable for use with alternate embodiments of the present invention.

Referring now to FIG. 4, an alternate power section 60, suitable for use with engines of the present invention, will be described. Such a power section may be substituted for the power section 32 in the embodiments of FIGS. 2 and 3 and, with other changes, could also be adapted for use with several variations of the invention.

Instead of the intermeshing gears of the previously discussed power sections, the present power section 60 is provided with a power rotor 61 centrally disposed within a housing 62. The rotor is provided with a plurality of radially extending vanes 63a, 63b, 63c which project for sealing rotational movement along the interior walls of housing 62. The rotor may be mounted on a shaft 64 which is suitably journaled in bearings (not shown) carried by the housing 62. If used in place of the power section 32 in the type of engine shown in FIGS. 2 and 3, the shaft 64 would be coaxially disposed with one of the power gears 35 and 36 and would correspond with either of the shafts 45 or 46.

Mounted within subhousings 65 and 66, which project outwardly from housing 62, are a pair of valve rotors 67 and 68. Although only two valve rotors are shown, any number could be utilized. Each of the valve rotors is mounted for rotation about corresponding shafts 69 and 70 which are suitably journaled in bearings (not shown) carried by the subhousings 65 and 66. Each of the valve rotors is provided with radial passages 71, 72, the purpose of which will be more fully understood hereafter.

It will be noted that the valve rotors are mounted in their corresponding subhousings 65 and 66 in a close fit. However, a portion of the interior of each of the subhousings is relieved to provide arcuate chambers 73 and 74 on one side thereof.

The valve rotors should be designed for rotation within their respective housing so as to rotate at some speed dependent upon the rotation of the power rotor 61. For this purpose, gears 75 and 76 may be attached to the ends of shafts 69 and 70 for meshing with a cooperating power gear 77 mounted on the end of power shaft 64. These gears may be conveniently mounted on the exterior of the housings 62, 65 and 66. In the particular embodiment shown in FIG. 4, the diameters of gears 75 and 76 are two-thirds the diameter of power gear 77, so that one-third of a revolution of gear 77 produces one-half of a revolution of the gears 75 and 76.

The valve rotor housings 65 and 66 are provided with inlet ports 79 and 80 which may be connected by suitable manifolding to a combustion chamber such as 33 in the embodiment of FIGS. 2 and 3. Thus, expanding gases from combustion are exposed to the valve rotors 67 and 68 through these ports.

To understand the operation of the power section 60, attention is first directed at the lower valve rotor 68. Expanding gases are admitted from the combustion chamber through the port 80 and valve rotor passage 72 for direction against the vane 63*c*. These expanding gases force the power rotor 61 to rotate in the direction indicated by the arrow until the vane 63*c* reaches a position substantially where the vane 63*a* is shown. During this movement, the expanded and burned gases on the counterclockwise sides of vane 63*c* are exhausted through one or more discharge ports 83*a* at the ends of housing 62. Exhaust ports 83*b* are also provided diametrically opposite exhaust ports 83*a*. When the vane 63*c* obtains position substantially 180° from a position in which it is shown in FIG. 4, more expanding combustion gases are supplied through ports 79 and valve rotor passage 71 to repeat the cycle. The arcuate chambers 73 and 74 would prevent compressed gases from being trapped inside the passages of the valve rotors.

It will be noted that the peripheries of power rotor 61 and valve rotors 67 and 68 tangentially contact each other as they are rotated. Were it not for the design of passages 71 and 72, this would create interference problems between the vanes 63*a*, 63*b* and 63*c* and the periphery of the valve rotors 67 and 68. However, the ends of the passages 71 and 72 are flared so as to permit entrance of the vanes as the vanes approach a corresponding valve rotor. Since the gears 75, 76 and 77 assure cooperative rotation, it is always assured that a flared passage will be provided for engagement with the vanes as they travel toward and away from each of the valve rotors.

At start-up, it is possible that a particular valve rotor might be in a position which would prevent combustion gases from entering the housing 62. For this reason, it may be necessary to provide an auxiliary port 84 with a valve member 85 which would be opened during startup. The port 84 would be connected by suitable manifolding (not shown) to the combustion chamber.

Several embodiments of a rotary internal combustion engine have been described herein. In each of the engines described, combustion takes place outside the power section or propulsion mechanism. This permits the combustion chamber to be designed in whatever configuration is required to ensure complete, efficient combustion and minimization of pollution. In addition, many of the reciprocating parts, valves, spark plugs and other components of the piston-crankshaft type internal combustion engines are eliminated. Fuel efficiency should be superior to that of a conventional engine. Maintenance and repair should be simplified and less costly.

Although several embodiments of the engine of the present invention have been described, many more could be developed by those skilled in the art without departing from the spirit of the invention. It is therefore intended that the scope of the invention be limited only by the claims which follow.

I claim:

1. A rotary internal combustion engine comprising a compressor section, a power section, and a combustion chamber therebetween; said compressor section comprising a pair of intermeshing gear members mounted in a compressor housing, inlet means on one side of said compressor housing and discharge means on the opposite side of said compressor housing, said intermeshing compressor gear members being mounted for rotation in opposite directions to compress and transfer air-fuel mixtures from said inlet means to said discharge means; said discharge means being connected to said combustion chamber for combustion of said compressed air-fuel mixtures; said power section comprising at least one power rotor mounted in a housing having inlet means connected to said combustion chamber through which exploding gases are directed against the periphery of said power rotor for driving an output shaft connected to said power rotor, said power rotor being connected to at least one of said compressor gear members for rotation of said compressor gear members; said power section comprising at least one valve rotor connected to said power rotor for cooperative rotation relative thereto, said power rotor being provided with a plurality of radial vanes projecting from the periphery thereof, said valve rotor being provided with valve ports which, upon rotation of said valve rotor, alternately permit and block flow of said exploding gases between said combustion chamber and the periphery of said power rotor, permitting said exploding gases to alternately expand against said power rotor vanes to rotate said power rotor, said power section being provided with exhaust means through which said expanded exploding gases may be selectively exhausted; said valve rotor comprising a radial passage therethrough, each end of which terminates at the periphery of said valve rotor, providing communication between said power section inlet and said power rotor periphery at preselected time intervals related to the rotation of said power rotor and said valve rotor.

2. An internal combustion engine as set forth in claim 1 in which said power rotor and one of said compressor gear members are coaxially mounted to effect said connection therewith.

3. A rotary internal combustion engine comprising: a compressor section, a power section, and a combustion chamber therebetween; said compressor section comprising a pair of intermeshing gear members mounted in a compressor housing, inlet means on one side of said housing and discharge means on the opposite side, said intermeshing gear members being mounted for rotation in opposite directions to compress and transfer air-fuel mixtures from an air-fuel source to said combustion chamber for combustion therein; said power section comprising a power rotor mounted in a cylindrical power housing and having radial vanes projecting therefrom, said power housing having inlet means through which expanding gases from said combustion chamber are directed against said power rotor vanes for effecting rotation of said power rotor, said cylindrical power housing having exhaust means in at least one end thereof communicating with the periphery of said power rotor and through which said expanded gases are exhausted; and comprising valve means at said power housing inlet means adapted to alternately permit and block flow of said expanding gases from said combustion chamber to said power rotor, said valve means including a rotor connected to said power rotor for related motion thereto and having a radial passage the ends of which terminate on opposite sides of said valve rotor, providing communication between said combustion chamber and said power rotor at selected rotational positions of said valve rotor.

4. An internal combustion engine as set forth in claim 3 in which said valve rotor is provided at one end thereof with a gear meshing with a corresponding gear at one end of said power rotor by which said valve rotor is rotated.

5. An internal combustion engine as set forth in claim 4 comprising a pair of said valve rotors on opposite sides of said power rotor, said power rotor having an odd numbered plurality of said radial vanes and having a diameter greater than the diameter of said valve rotors.

* * * * *